United States Patent [19]

Rathert

[11] 4,300,427

[45] Nov. 17, 1981

[54] THREE-KNIFE TRIMMER

[75] Inventor: Horst Rathert, Minden, Fed. Rep. of Germany

[73] Assignee: Rahdener Maschinenfabrik August Kolbus GmbH & Co. KG, Wesphalia, Fed. Rep. of Germany

[21] Appl. No.: 98,650

[22] Filed: Nov. 29, 1979

[30] Foreign Application Priority Data

Dec. 7, 1978 [DE] Fed. Rep. of Germany ..... 2852878

[51] Int. Cl.[3] ..... B26D 1/09; B26D 1/11

[52] U.S. Cl. ..... 83/519; 83/327; 83/646; 83/925 A; 83/215; 74/660

[58] Field of Search ..... 83/925 A, 646, 519, 83/327, 214, 215; 74/660, 52, 750

[56] References Cited

U.S. PATENT DOCUMENTS

| | | | |
|---|---|---|---|
| 1,980,220 | 11/1934 | Morton | 74/660 |
| 3,057,241 | 10/1962 | Chambon | 83/646 |
| 3,528,332 | 9/1970 | Thumim | 83/925 A |
| 4,202,232 | 5/1980 | Müller | 83/925 A |
| 4,223,568 | 9/1980 | Brems | 74/660 |

*Primary Examiner*—Donald R. Schran

*Attorney, Agent, or Firm*—Fishman and Van Kirk

[57] ABSTRACT

Cutting apparatus with three blades, for trimming three sides of an inner book or the like, having a drive system which permits the simultaneous trimming of two opposed sides of the work closely followed by the trimming of the third side. Operation of the third cutting blade while the other two are still in motion is permitted by driving the simultaneously operated blades along a multi-directional orbital path.

13 Claims, 5 Drawing Figures

THREE-KNIFE TRIMMER

BACKGROUND OF THE INVENTION (1) Field of the Invention

The present invention relates to the cutting of sheet material and particularly to the trimming of stacked paper sheets such as, for example, in the manufacture of books. More specifically, the present invention is directed to a three-cutter guillotine for trimming sheet material by cutting along three sides of such material. Accordingly, the general objects of the present invention are to provide novel and improved methods and apparatus of such character.

(2) Description of the Prior Art

While not limited thereto in its utility, the present invention is particularly well suited for use in the manufacture of books. It is often necessary, in the course of the manufacture of a book, to trim the inner book to size by effecting cuts along three sides which are respectively known in the trade as the "head", "foot", "front" sides. Apparatus for performing this trimming is known as a guillotine. Guillotines employing three cutting blades or knives are known. In such prior art three-cutter guillotines, the work is automatically guided beneath the cutters, aligned and maintained on a cutting table by means of a press ram and the head and foot trimming occurs in a first work stroke. Subsequently, the front trimming is effected in a second work stroke. The work is thereafter automatically ejected from the guillotine and placed on a conveyor belt.

The prior art three-cutter guillotines, as briefly described above, perform trimming cuts which are spaced in time; i.e., the front trimming is not performed until the head and foot trimming has been completed and the cutter blades employed therein fully retracted. Accordingly, previously available three-cutter guillotines have been severely restricted in operating speed to the extent that such apparatus cannot be integrated into present-day high capacity production lines.

In an effort to overcome the above-discussed problem of slow operating speed of three-cutter guillotines, two-station flow cutters have been proposed wherein trimming is accomplished at two successive cutting stations. Specifically, the head and foot trimming are executed in a first station and the front side trimming will occur at a subsequent second station. Pressing, transfer from the first to the second station and feed and discharge all occur automatically. While an enhanced operational speed has been achieved with two-station flow cutters as compared to prior three-cutter guillotines, an increase in manufacturing capacity has not been realized for a number of reasons. Firstly, the height of the stack to be cut is limited due to the transport between cutting stations. Secondly, the precision with which the cuts are made has suffered as a result of the added handling of the work. It is also to be noted that two-station flow cutters are quite costly, due to their structural complexity, and are generally considered as requiring an excessive amount of floor space.

SUMMARY OF THE INVENTION

The present invention overcomes the above briefly-discussed deficiencies and disadvantages of the prior art by providing a novel and improved cutting technique and a three-cutter guillotine which operates in accordance with this novel technique. The present invention is capable of trimming inner books, booklets, etc. on three sides at a single cutting station. The operation of apparatus in accordance with the present invention is characterized by high precision and increased operating speed when compared to the prior art.

Apparatus in accordance with the present invention includes a drive mechanism which transports the blades of the head and foot trimming cutters, which are usually parallelly oriented, out of their cutting orbit after they have made their cuts thereby permitting their front trimming cutter blade to function with a slight time delay. In accordance with a preferred embodiment of the invention, a gearing arrangement is employed which produces movement of the head and foot cutter blades in a hypocycloidal orbit with four cusps. According to a further feature of a preferred embodiment of the present invention, a three-cutter guillotine is characterized by a support shaft on which the head and foot trimming cutters are mounted. The ends of this support shaft are carried by rocker arms which, in turn, are coupled to a drive system including a crank arm which is caused to follow a circular path and which is coupled to the rocker arm by means of an eccentric connection.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGS. and in which.

Figure 1:
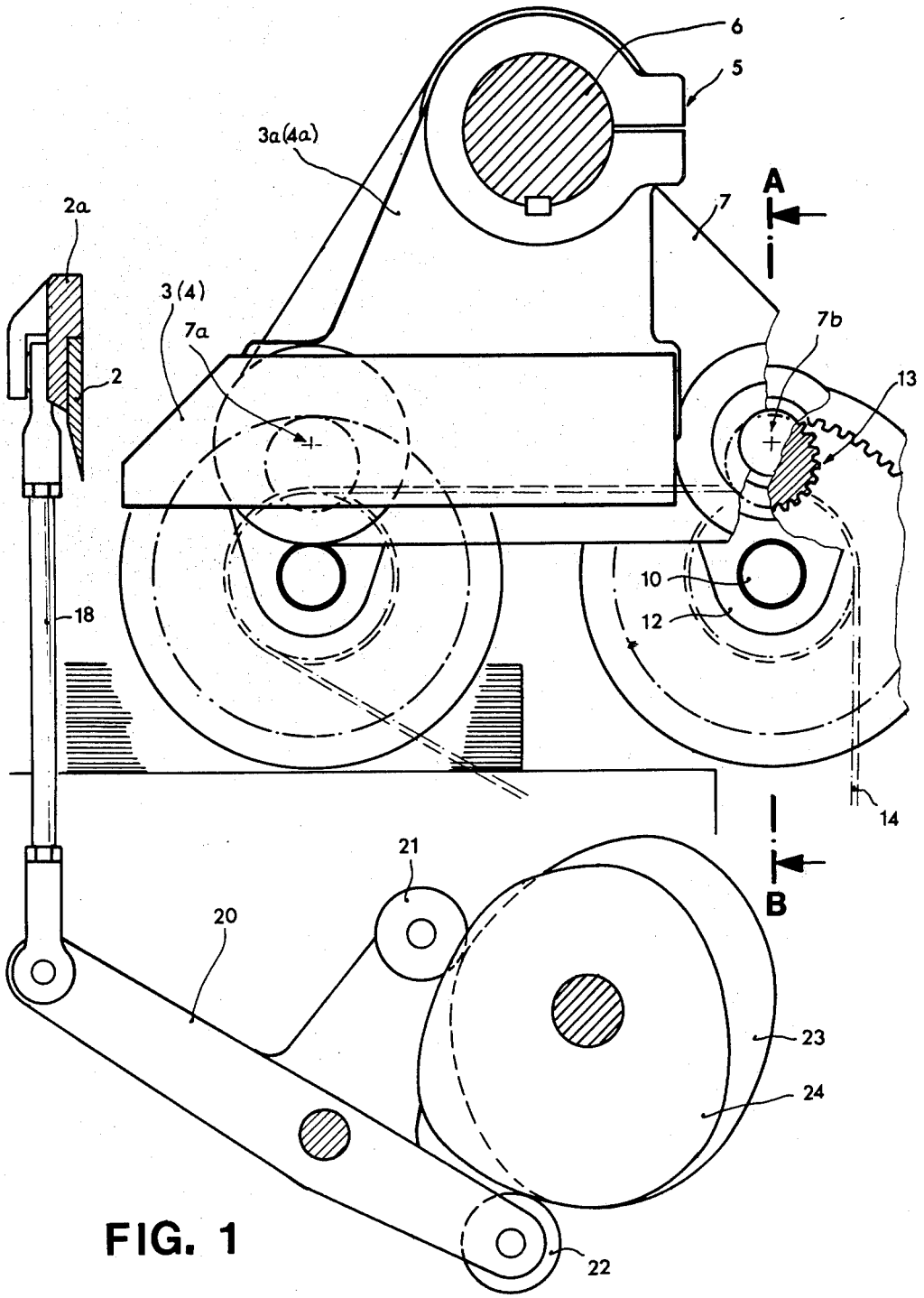
FIG. 1 is a side elevation view, partly in section, of a three blade quillotine in accordance with a preferred embodiment of the present invention.

DESCRIPTION OF THE PREFERRED EMBODIMENT:

With reference now to the drawing, apparatus in accordance with the present invention includes three movable cutting blades 2, 3 and 4 which may be employed to trim a stack of paper such as, for example, the inner book which has been indicated generally at 1. Using the common terminology in the book making art, blade 2 is the "front" cutter while blades 3 and 4 are respectively the "foot" and "head" trimming cutters. Blade 2 is affixed to a support 2*a* while blades 3 and 4 are respectively carried by cutter supports 3*a* and 4*a*. The cutter supports 3*a* and 4*a* are clamped to a movable support shaft 6 by means of clamps such as generally indicated at 5. The format size may be adjusted by loosening the clamps 5 and thereafter sliding the cutter supports 3*a* and 4*a* axially along shaft 6.

In accordance with the present invention, the drive of the blade 2 is coordinated with that of blades 3 and 4 such that the front trimming of the work 1 will occur immediately subsequent to the foot and head trimming. Before the front trimming can occur, the blades 3 and 4 must be cleared. Restated, the two lateral cutters must be transported out of their cutting orbit so that they will not interfere with the front cutter. In accordance with the present invention, in order to operate the front cutter with only a slight phase delay with respect to the operation of the lateral cutters, the blades 3 and 4 are driven on a path which defines a hypocycloid of four cusps. While there are several means by which the desired movement may be produced, the description below will be directed to a system which employs a toothed gear wheel. In an actual reduction to practice, two such toothed gear wheels are used. The motion producing means, which respectively attack pivot points 7*a* and 7*b* of a rocker arm 7, drive the support shaft 6.

Figure 2:
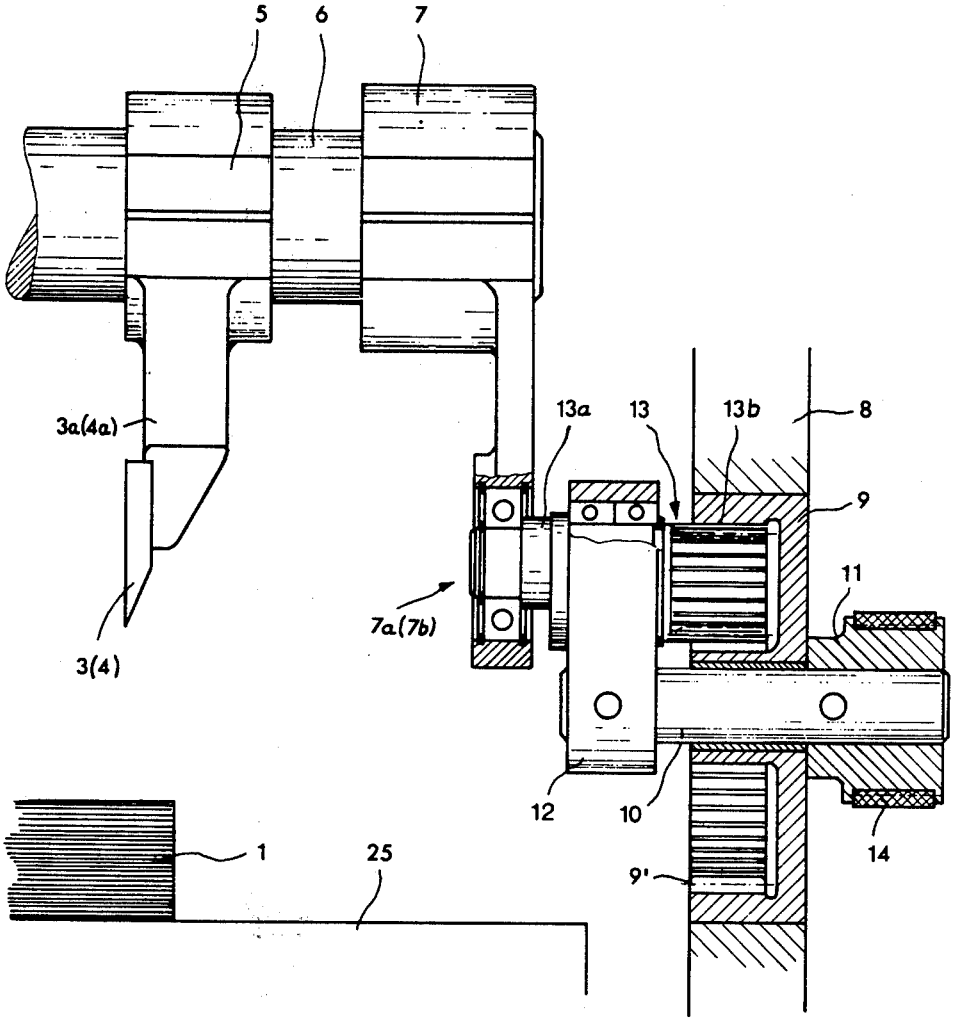
FIG. 2 is a view taken along line A-B of FIG. 1.

Referring to FIG. 2, a gear 9 is mounted in the frame 8 of the guillotine apparatus. Gear 9 is provided with an annular cut-out with internal gear teeth having been formed about the outer diameter of this cut-out. The gear 9 is coaxial with a drive shaft 10 which extends therethrough. Drive shaft 10 is rotatable relative to gear 9. A pinion 11 is keyed or otherwise affixed to the first or outwardly disposed end of drive shaft 10. Pinion 11, and thus shaft 10, are driven by a toothed belt 14 (see also FIG. 1). The belt 14 is, in turn, driven from the main drive of the apparatus; the belt drive having been omitted from the drawing. The second or inwardly disposed end of drive shaft 10 is affixed to a crank 12 adjacent a first end thereof. Crank 12, adjacent its second end, rotatably supports a shaft pinion indicated generally at 13. Pinion 13 includes an eccentric coupling 13*a* to rocker arm 7 and a gear 13*b* which meshes with the internal teeth 9' in gear 9. Rotation of drive shaft 10 will be transmitted to crank 12 whereupon the gear 13*b* will travel about the circle defined by the outer diameter of the annular recess in gear 9. The circular movement of the end of crank 12 and the simultaneous rotation of eccentric coupling 13*a* produce the desired astroidal path of motion of pivot point 7*a* and thus of support shaft 6.

In order to reduce the cutting forces, the blades 3 and 4 of the lateral cutters are caused to penetrate the inner book 1 at an angle which is preferably about 3 degrees. This oblique cut, which is common in the art, is achieved by adjusting one of the cranks 12 relative to its pivot point by about 10 degrees in the direction of travel when compared to the connection of the other crank 12 to its pivot point.

The front cutter support 2*a* is suspended from frame 8 by means of a parallelogram linkage, not shown, and the forces for operating the blade 2 are delivered to support 2*a* by means of traction bars, only a first bar 18 being shown. Traction bar 18 is coupled to the first end of a rocker arm 20 which is set into motion by a pair of cam followers 21 and 22 which respectively ride on cams 23 and 24. The rocker arm 20 is mounted for pivoting motion about a shaft anchored in the guillotine frame 8 and cams 23 and 24 are similarly mounted and are driven from the main drive of the apparatus. Accordingly, the upward and downward movements of cutter 2 result from the rotation of cams 23 and 24 and these cams are adjusted on their shaft such that the blade 2 will perform its cutting action immediately subsequent to the cutting effected by the blades 3 and 4. As in the case of blades 3 and 4, the cutting forces required for blade 2 are reduced by establishing an oblique position for blade 2.

Figure 3A:
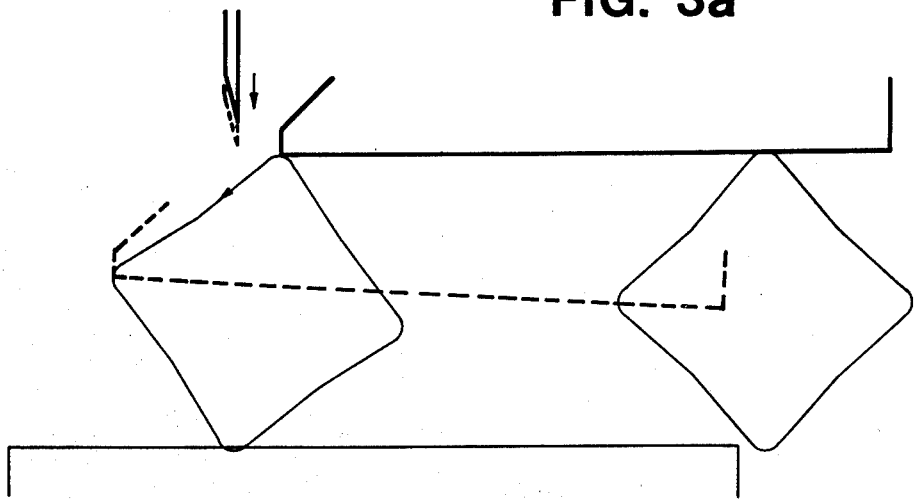
FIGS. 3*a* through 3*c* schematically illustrate the sequence of operation and the movement of the cutter blades of the apparatus of FIGS. 1 and 2.
Figure 3B:
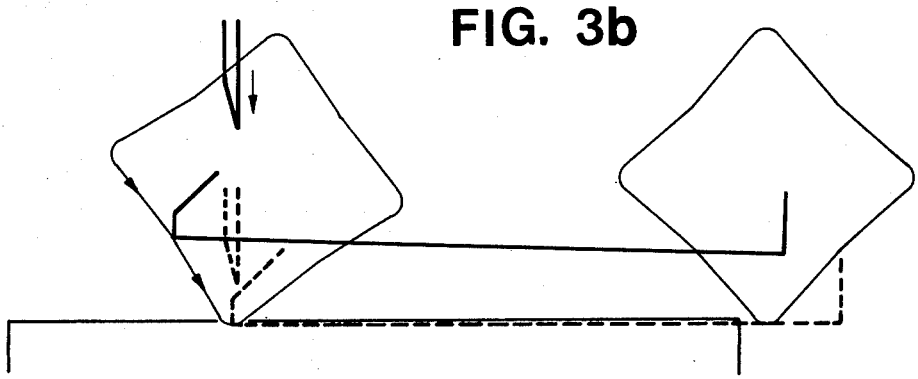
Figure 3C:
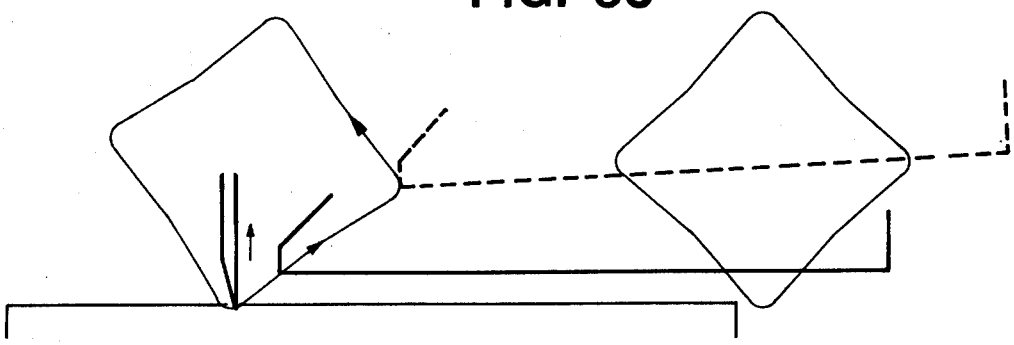

The operation of the present invention may be seen by reference to FIG. 3 which schematically illustrates the motion of the blades 2, 3 and 4. FIG. 3 clearly shows the hypo-cycloidal orbit of the blades 3 and 4 as they perform the lateral trimming cut; this orbit having four cusps. As depicted in FIG. 3, the oblique oscillating cut is executed on a line which is inclined at approximately 35 degrees with respect to the horizontal and, subsequent to completion of the cut, the blades 3 and 4 are moved along the orbit to their initial position as shown in solid lines in FIG. 3*a*. The actual cutting by lateral blades 3 and 4 proceeds from a point subsequent to the position shown by means of a broken line in FIG. 3*a* to the position depicted by means of the broken line on FIG. 3*b*. FIG. 3 also depicts the synchronized, but out of phase, movement of the front cutter blade 2 with FIG. 3*b* showing that the front trimming is effected immediately after completion of the lateral cuts.

As is well known in the art, the product to be cut, for example the inner book 1, rests upon a table 25 and the cutting is performed by a crushing cut against plastic rails set into table 25. It is likewise known, and therefore not shown, that the inner book is maintained on table 25 by a press ram during cutting.

While a preferred embodiment has been shown and described, various modifications and substitutions may be made thereto without departing from the spirit and scope of the invention. Thus, by way of example, the drive for the lateral cutter blades 3 and 4 may be effected by causing the cutters to follow an orbit which is a hypocycloid with three cusps. In such case, the use of an intermittent gear is required. Drive of the two lateral cutters with a slight phase offset relative to the cut of the front cutter may alternatively be achieved through the use of cam tracks. Further, instead of employing a table with inserted plastic rails to generate a crushing cut, the present invention may be employed to control the effecting of sheering cuts by means of counter-blades; this presenting advantages for certain products such as booklets with covers. Accordingly, it will be understood that the present invention has been described by way of illustration and not limitation.

What is claimed is:

1. Apparatus for trimming edges of a stack of papers positioned upon a cutting table comprising:

side knife means, said side knife means including at least a first cutting blade having a linear cutting edge;

front knife means said front knife means including a second cutting blade having a cutting edge oriented transversely with respect to the cutting edge of said first cutting blade;

first moveable support means for said side knife means;

second moveable support means for said front knife means;

first drive means, said first drive means causing said first support means to move in a first direction from a starting position whereby said side knife means is brought into contact with the stack of paper to produce the desired trimming of at least one side edge thereof, said first drive means further causing said first support means to move in a second direction after the desired trimming is produced, whereby said side knife means is returned to its starting position, said first and second directions following a multi-directional orbital path; and second drive means, said second drive means causing said second support means to move in a direction whereby said front knife means is brought into contact with the stack of paper to produce the desired trimming of the front edge thereof, said second drive means causing said second support means to move simultaneously and in synchronism with the movement of said first support means, said second drive means causing said second support means to move said front knife means into contact with the stack of paper subsequent to said side knife means trimming said side edge of the stack of papers as said first support means begins to move in said second direction whereby said trimming produced by said front and said side knife means is performed with a small phase offset.

2. The apparatus of claim 1 wherein said first drive means causing said first support means to follow a hypocycloidal path.

3. The apparatus of claim 2 wherein said hypocycloidal path has at least three cusps.

4. The apparatus of claim 2 wherein said hypocycloidal path has four cusps.

5. The apparatus of claim 1 wherein said first movable support means comprises a support shaft and wherein said first drive means for said first support means includes:

rocker means, said rocker means being attached to said support shaft at two spacially displaced locations; and hypocycloidal motion generating means attached to said rocker means.

6. The apparatus of claim 5 wherein said hypocycloidal motion generating means comprises:

elongated crank means, said crank means being supported adjacent a first end thereof for rotation with a drive shaft whereby the second end of said crank means will transcribe a circular path;

stationary track defining means;

rotatable follower means supported on said crank means adjacent the second end thereof, said rotatable follower means engaging said stationary track defining means;

eccentric coupling means connected to said rotatable follower means and carried by said crank means, said eccentric coupling means having an output shaft, cooperation between said rotatable follower means and said stationary track defining means causing said eccentric coupling means output shaft to move relative to the second end of said crank means while movement along said circular path occurs; and means connecting said eccentric coupling means output shaft to said rocker means.

7. The apparatus of claim 6 wherein said first drive means for said first support means causes said side knife means to follow a hypocycloidal path.

8. The apparatus of claim 7 wherein said hypocycloidal path has at least three cusps.

9. The apparatus of claim 7 wherein said hypocycloidal path has four cusps.

10. The apparatus of claim 9 wherein said second drive means for said second support means comprises:

a pair of rotatable cams;

second rocker means, said second rocker means including a pivotal rocker arm;

cam follower means carried by said second rocker means, said cam follower means contacting said cams and imparting motion to said rocker arm at a first side of its pivot point in response to the rotation of said cams; and means coupling said second support means to said second rocker means rocker arm at the second side of its pivot point whereby reciprocal motion is transmitted to said front knife means.

11. The apparatus of claim 7 wherein said track defining means each comprise:

a gear wheel; and wherein said follower means each comprise:

a rotatable pinion gear.

12. The apparatus of claim 11 wherein said hypocycloidal path has four cusps.

13. The apparatus of claim 12 wherein said second drive means for said second support means comprises:

a pair of rotatable cams;

second rocker means, said second rocker means including a pivotal rocker arm;

cam follower means carried by said second rocker means, said cam follower means contacting said cams and imparting motion to said rocker arm at a first side of its pivot point in response to the rotation of said cams; and means coupling said second support means to said second rocker means rocker arm at the second side of its pivot point whereby reciprocal motion is transmitted to said front knife means.

* * * * *